US008579345B2

(12) United States Patent
LeClaire et al.

(10) Patent No.: US 8,579,345 B2
(45) Date of Patent: Nov. 12, 2013

(54) LADDER HANDLE AND TRANSPORTING DEVICE

(75) Inventors: Randy LeClaire, Cupertino, CA (US); Jay Lord, Los Gatos, CA (US); Stephen Fisher, Los Gatos, CA (US)

(73) Assignee: IQPod, LLC, Los Gatos, CA (US)

( * ) Notice: Subject to any disclaimer, the term of this patent is extended or adjusted under 35 U.S.C. 154(b) by 0 days.

(21) Appl. No.: 13/506,577

(22) Filed: Apr. 30, 2012

(65) Prior Publication Data

US 2013/0009414 A1 Jan. 10, 2013

Related U.S. Application Data

(60) Provisional application No. 61/519,127, filed on May 16, 2011, provisional application No. 61/628,263, filed on Oct. 26, 2011.

(51) Int. Cl.
*A45F 5/00* (2006.01)

(52) U.S. Cl.
USPC ..... 294/151; 294/15; 182/129; 16/422

(58) Field of Classification Search
USPC ..... 294/151, 26, 15–16, 18, 137, 150, 294/153–154, 165, 170; 182/129; 16/110.1, 16/422
See application file for complete search history.

(56) References Cited

U.S. PATENT DOCUMENTS

| | | | | |
|---|---|---|---|---|
| 1,243,638 | A * | 10/1917 | Spurrier | 294/154 |
| 2,978,154 | A * | 4/1961 | Kailey | 294/154 |
| 2,997,326 | A * | 8/1961 | Daum | 449/62 |
| 3,337,102 | A * | 8/1967 | Shannon | 294/168 |
| 5,511,285 | A * | 4/1996 | Bush et al. | 16/422 |
| 6,390,238 | B1 * | 5/2002 | Gibson et al. | 182/161 |

* cited by examiner

*Primary Examiner* — Stephen Vu
(74) *Attorney, Agent, or Firm* — Jonathan E. Grant; Grant Patent Services

(57) ABSTRACT

A ladder handle and transporting device is disclosed. The device allows for ladders to be carried by a handle affixed to the side of the ladder. The device includes a handle, straps, and a rail support section. Another embodiment of the disclosure allows for a ladder handle and transporting device for extension ladders.

8 Claims, 5 Drawing Sheets

Fig.1
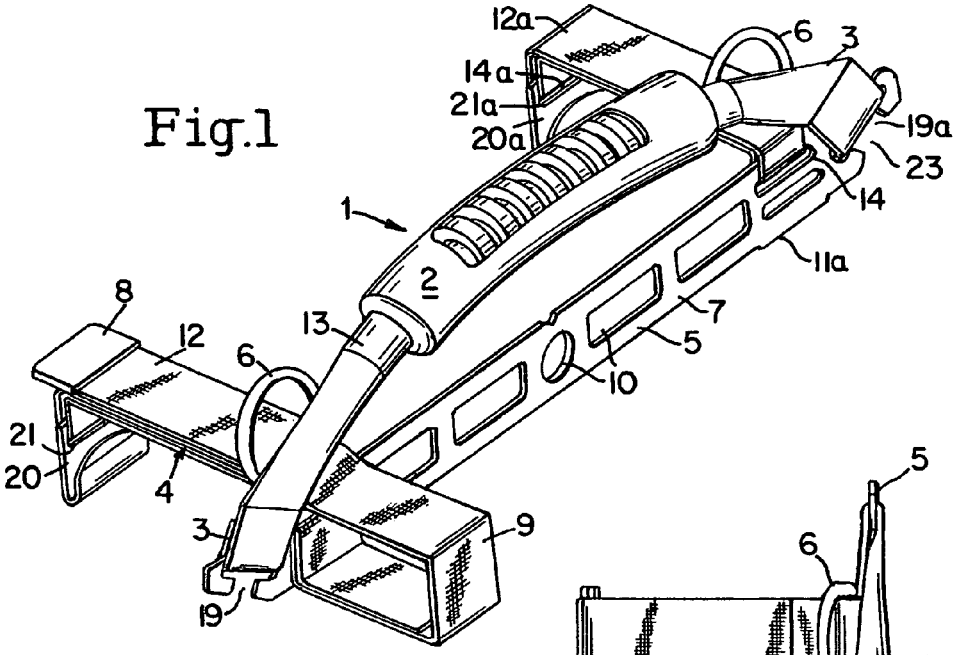
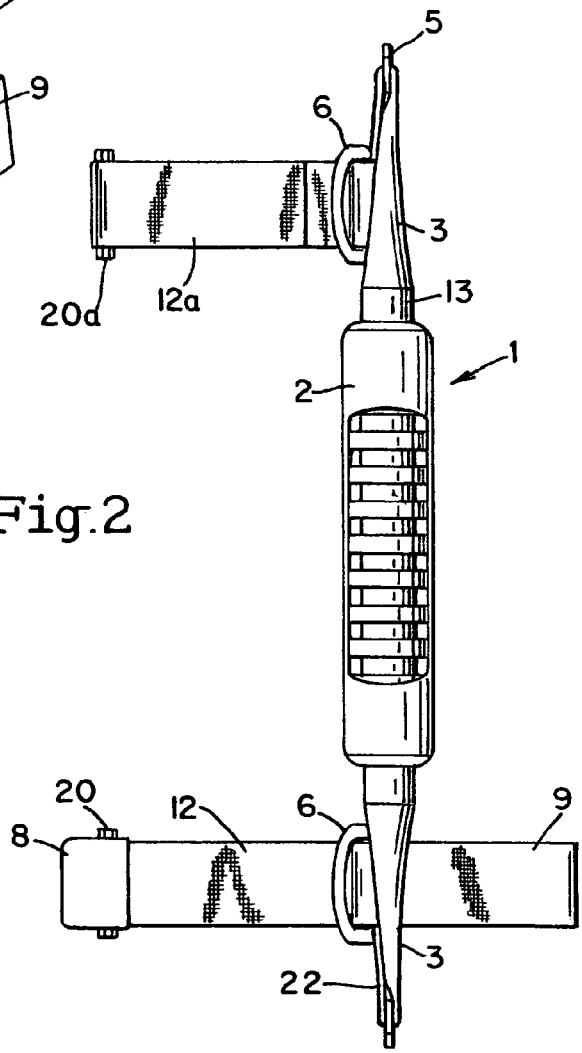
Fig.2

Fig.3
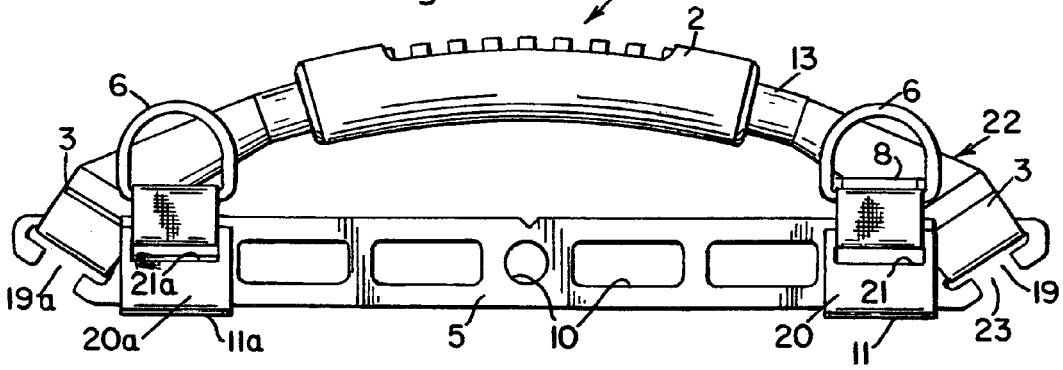
Fig.4
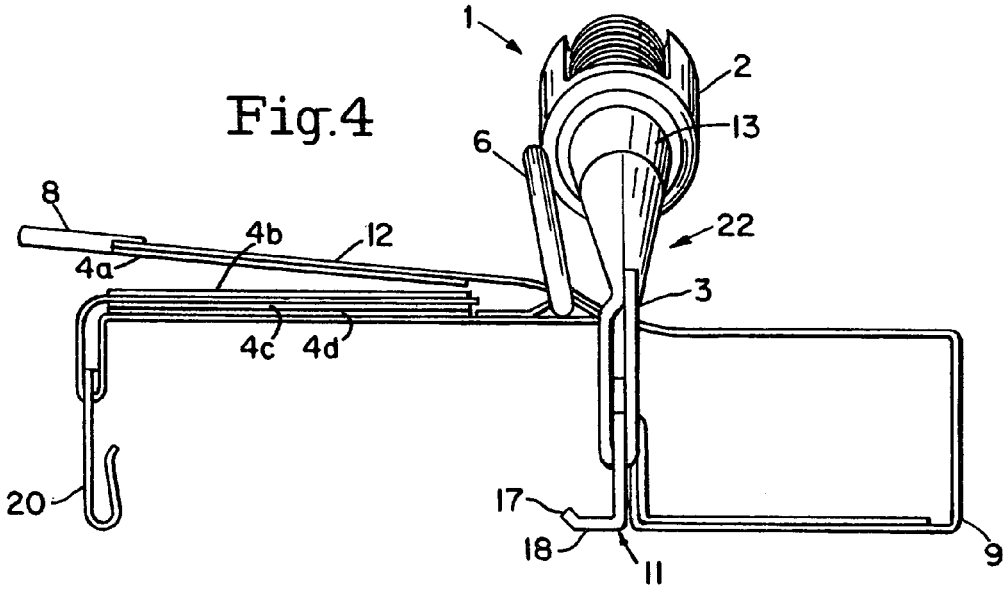
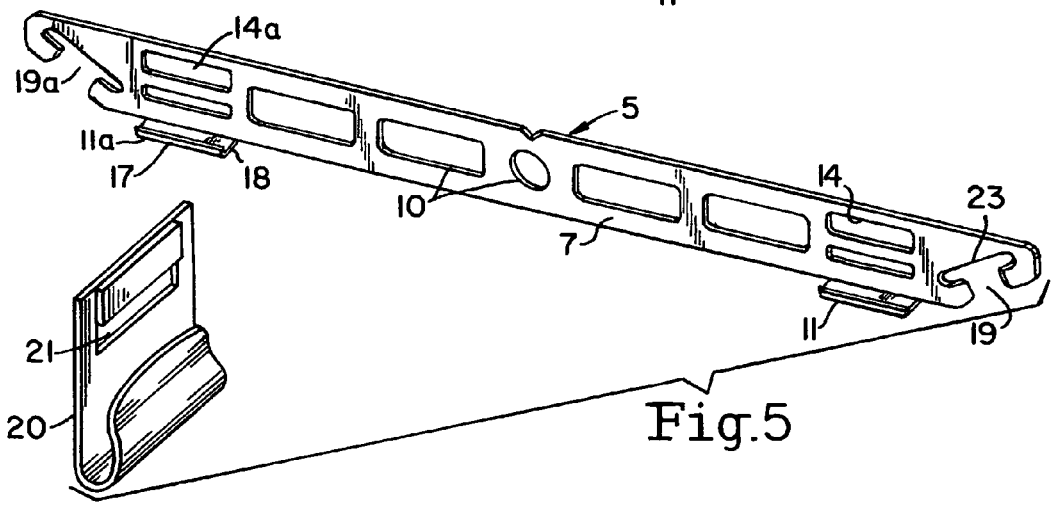
Fig.5

Fig.10
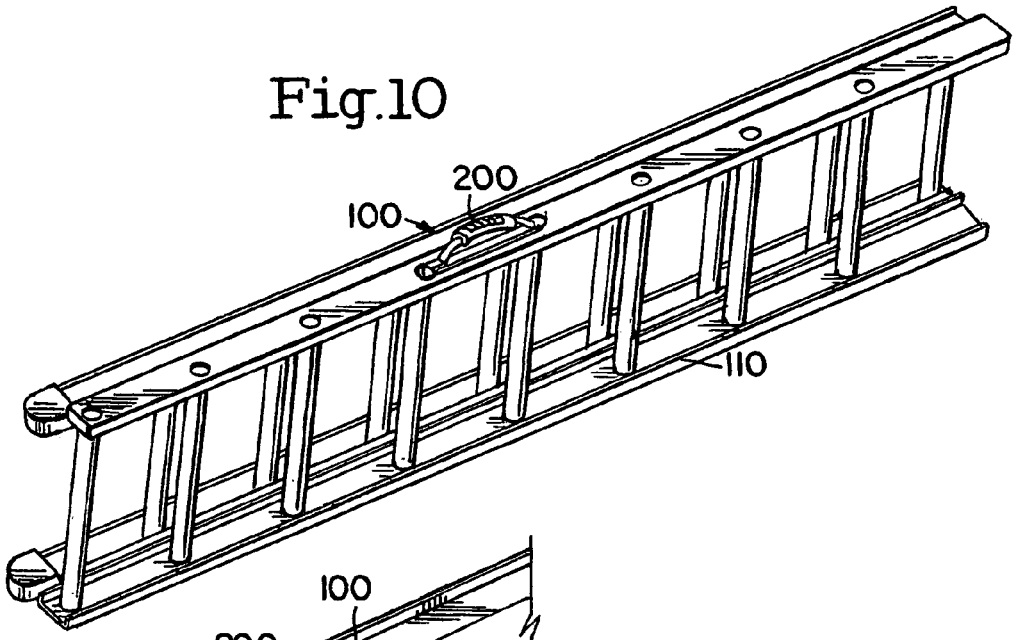
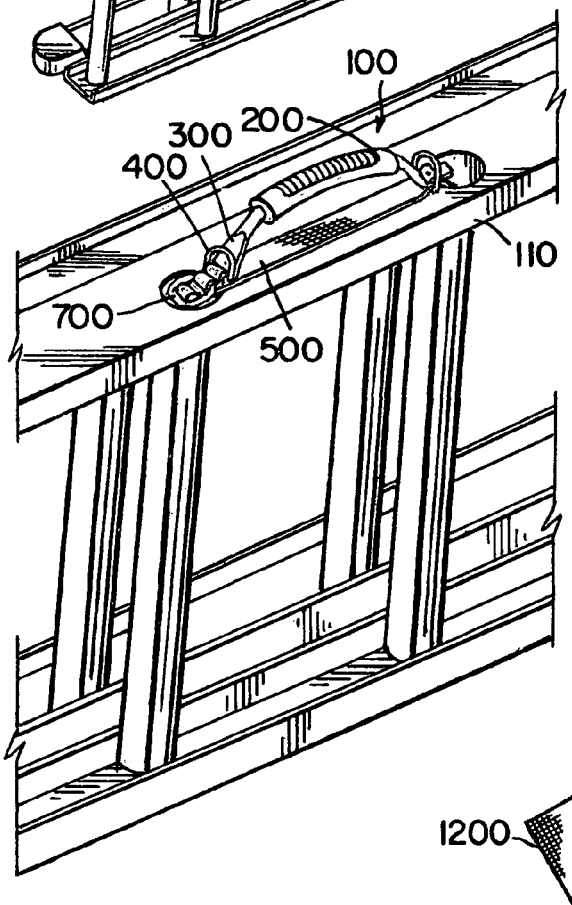
Fig.11
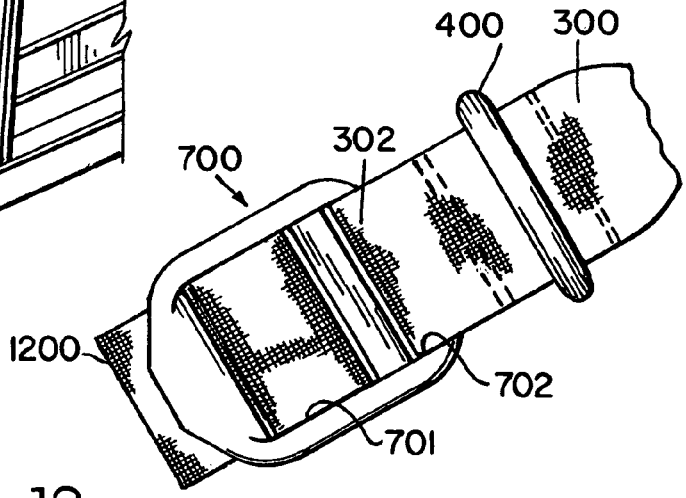
Fig.12

LADDER HANDLE AND TRANSPORTING DEVICE

This application claims priority to provisional application 61/519,127 filed May 16, 2011, and to provisional application No. 61/628,263, filed Oct. 26, 2011.

BACKGROUND OF THE DISCLOSURE

Ladders are inherently one of the most important tools for a craftsman, yet one of the hardest to carry. There have been various methods for lifting and transporting step ladders from one location to another, but these methods can often cause the ladder to swing wildly, thereby damaging property and injuring people, including the craftsman.

SUMMARY OF THE DISCLOSURE

The present disclosure allows for a safe and easy way to carry a ladder that will lead to fewer accidents and injuries.

In one embodiment of the disclosure, the ladder handle and transporting device comprises a handle assembly, fasteners to support to the ladder, rail support section along with two rail strap assemblies and which are passed through two strap rail clips and one additional small rail support strap which is sewn to the bottom section of strap. The device can be a constructed of a durable medium that is longwearing and capable of being produced very inexpensively.

The device facilitates lifting and transporting step ladders from one location to another while holding and/or strapping both sections of the ladder together to prevent spreading of the ladder. An ergonomic solution is provided to allow for lifting and transporting step ladders while from one location to another. The handle assembly for carrying ladders promotes the safety of the individual in relation to the user, other persons and property. Additionally, handle assembly allow the ladder to be safely carried by one hand of the user while enabling the user to stand in an ergonomically correct position.

In one embodiment of the device, device has a strap which when wrapped around the support section of the ladder will clamp both sections of the ladder together for lifting and transporting.

Another embodiment of the disclosure provide a means to strap-on and/or clip the device to the ladder over a user selected balance point of the ladder to permit safely carrying the ladder below the waist to allow the ladder to tilt upwardly or downwardly when the user is walking up or down stairs or also over sloped terrain.

In another embodiment of the disclosure, the handle assembly is flexible and can be compressed down against the side rail of the ladder when not in use.

In another embodiment of the disclosure, the device is used for hanging or storing the ladder by positioning the handle on a pole or hook.

In another embodiment of the disclosure, a shoulder strap is attached to the D-rings located at each end of the handle to carry the weight of the ladder on one's shoulder.

In another embodiment of the disclosure, the assembly can be attached to a ladder for temporary or permanent use.

Another embodiment of the disclosure is a version of the device that can be used for extension ladders. Consequently, in one embodiment the handle compresses down and against the side rail of the ladder when not in use. The handle may be raised for convenient balance of the ladder for carrying by one hand of the user while standing in upright position. This version of the disclosure also allows for the hanging or storing of the ladder by positioning the handle on a pole or hook, as well as the positioning of two D-rings at each end of the handle.

Further area of applicability of the present disclosure will become apparent from the detailed description provided hereinafter. It should be understood that the detailed description and specific examples, while indicating various embodiments of the disclosure, are intended for purposes of illustration only, since various changes and modifications within the spirit and scope of the disclosure will become apparent to those skilled in the art from the specification.

BRIEF DESCRIPTION OF THE DRAWINGS

FIG. 1 is a perspective view of the ladder handle and transporting device;

FIG. 2 is a top view of the ladder handle and transporting device;

FIG. 3 is a side view of the ladder handle and transporting device;

FIG. 4 is an end view of the ladder handle and transporting device;

FIG. 5 is a perspective view of rail support section of the ladder handle and transporting device;

FIG. 10 is a perspective view of the present disclosure mounted on a ladder;

FIG. 11 is another perspective view of the present disclosure mounted on a ladder; and FIG. 12 is another perspective view of another embodiment of the device.

DETAILED DESCRIPTION OF THE DISCLOSURE

Figure 6:
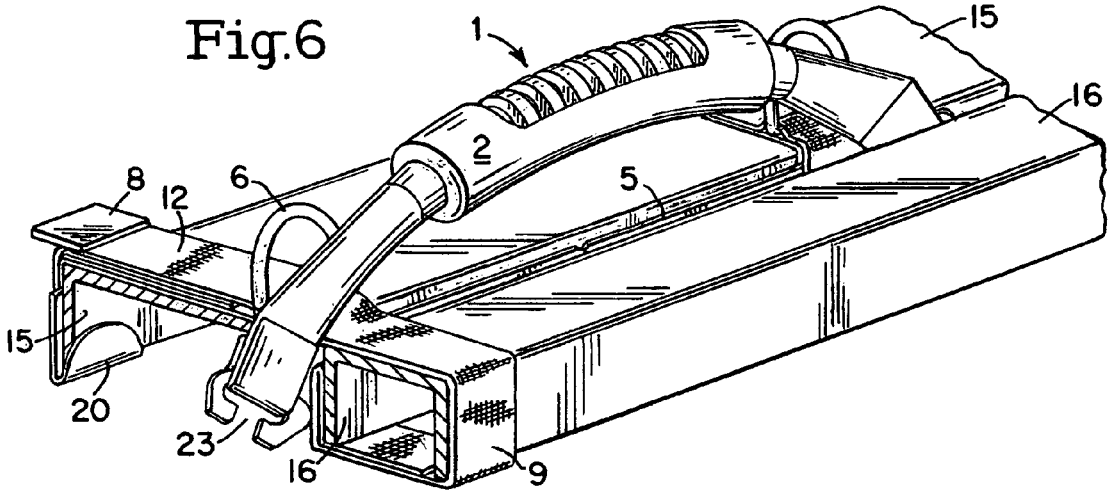
FIG. 6 is a close up perspective view of the ladder handle and transporting device in use.
Figure 7:
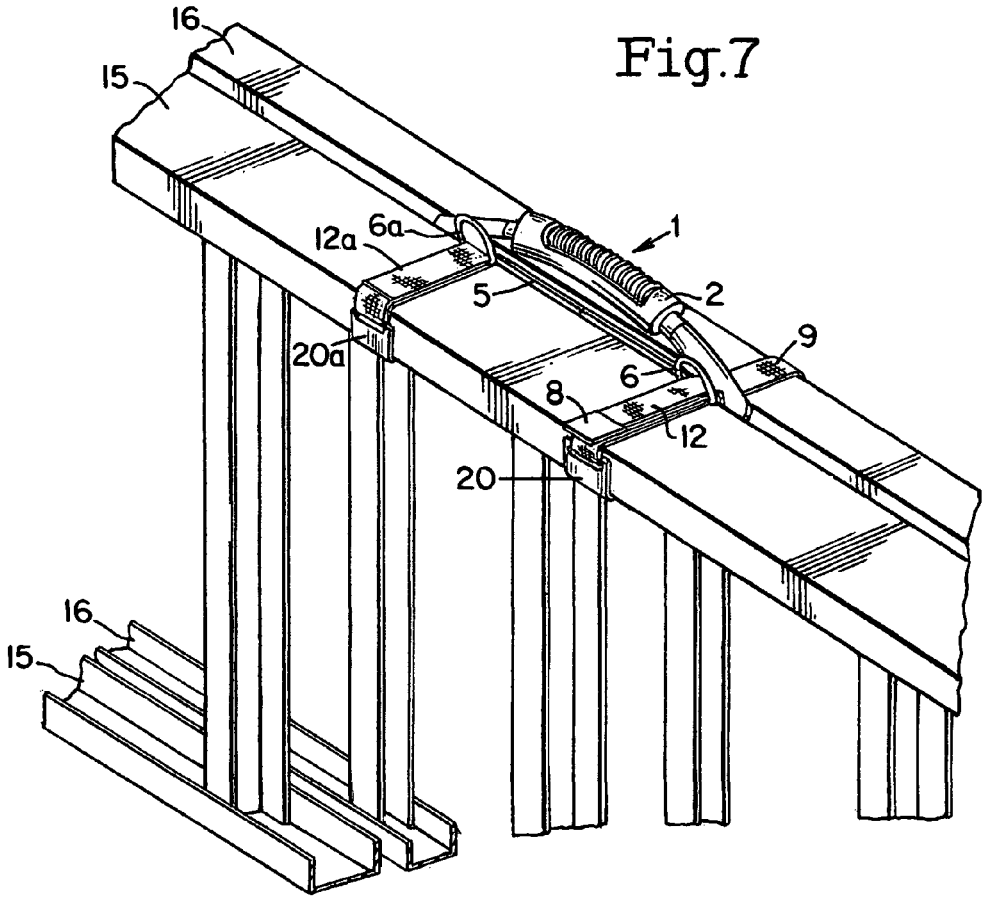
FIG. 7 is another perspective view of the ladder handle and transporting device present invention positioned on the ladder rails.
Figure 8:
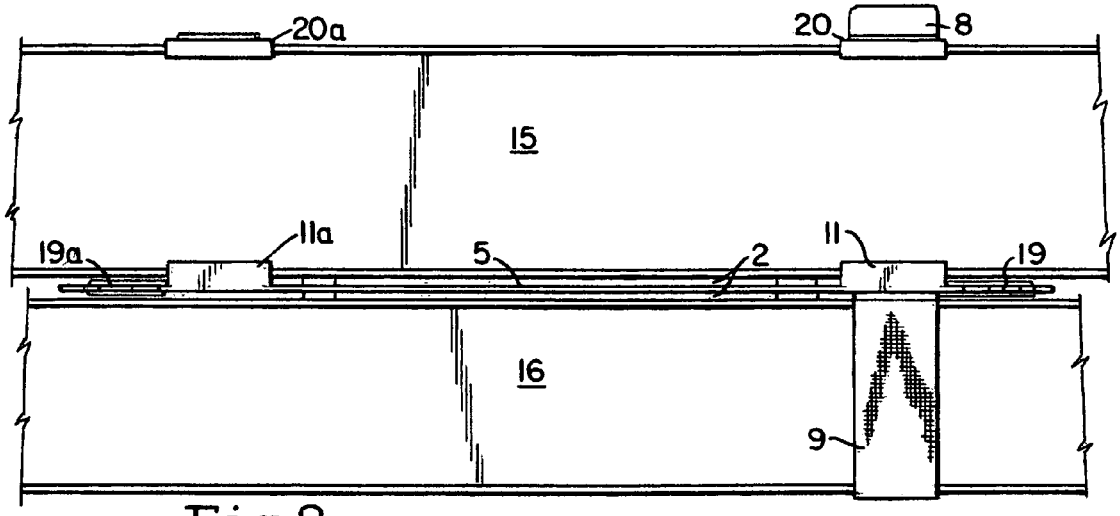
FIG. 8 is a bottom view of the ladder handle and transporting device installed on the ladder rails.

Referring to FIGS. 1 through 8, the ladder handle and transporting device 1 generally comprises a handle assembly 2 which is attached with fasteners 3 to the rail support section 5. The handle assembly 2 may be made of vulcanized rubber, rubber, fabric, metal, plastic, or just about any other material. Depending on the material of which it is made, the handle include a stiffening material 13 inserted into the center and sewn into place for improved support and user comfort.

The rail support section 5 compromises an elongated bar. The bar may be comprised of metal, plastic, resin, wood, or any other rigid material that does not easily break. The elongated bar can be round or flat, oblong, trapezoidal, square, or rectangular. The rail support section 5 may incorporate additional features 7 such as powder coating, plastic coating or anodizing on the material to reduce cost, increase strength and or for appearance.

The rail support section 5 also has two slots 19 and 19*a* at (its) opposite ends with a centered opening 23 through which the sewn handle 2 ends 22 are looped and sewn or vulcanized together. The slots 19 are of any shape, position, or size to accommodate the handle ends 22. In the figures, the slots 19 are positioned diagonally. The fasteners 3 may be fabric, rope, chain, plastic ties, nylon, or virtually any other material that is sturdy. Flexible materials and even non-flexible materials can be used. In the case of a fabric or cloth material, or any of the other materials, the material is fed through a hollow handle 2, and at each end the material is fed through slots 19 and 19*a*. Hence, the fasteners 22 are and their ends thereof are made of one integral piece that is fed through the hollow handle. The material is then folded back on itself and glued, sewed, buckled, riveted, or heat sealed together, depending on the material being used. However, before the ends are secured, stiffening material 13 can be inserted through the cloth or other material into said handle, or directly into the handle, making the handle easier to grasp and the ladder easier to carry. In an alternative embodiment, there may be sewn to the material passed through the handle separate handles or separate handle ends.

Additionally, the rail support section 5 includes cutouts 10 for appearance and weight reduction and for other straps to be attached. These cutouts 10 can be of any shape, size, or number, as long as the strength and integrity of the rail support section is maintained. The rail support section 5 also includes a rail support clip, and preferably at least two rail support clips 11 and 11*a* positioned at each end on the inside bottom edge. The two rail support clips 11 and 11*a*, which may be integrally molded with the rail support section, extend outward 18 at a right angle to the rail support section 5 and allow the rail support section 5 to firmly support the large ladder rail 15 while still allowing clearance of the ladder step supports 20. The two rail support clips 11 and 11*a* have a toe 17, 17*a* positioned upward at about a 90 degree angle, forming an "L" shape to ensure capture of the large ladder rail 15, with the toe 17 being about 17 parallel with the rail support section. In an alternative embodiment, they may have an angle somewhat greater than 90 degrees, making it easier for the ladder rail to be fit into the support clips.

Additionally, the device comprises two ladder straps 12 and 12*a*. These ladder rail straps may be made of a plastic, fabric, or cloth. A thin metal backing or insertion may be included in either embodiment, as strengtheners. Otherwise, a thick fabric or cloth is suitable. Each of the two ladder rail straps 12 and 12*a* have a hook and loop (Velcro) section 4*a*, 4*b*, 4*c* and 4*d* sewn to opposite sides of each straps.

The rail straps 12 and 12*a* are attached to rail support system 5 through rail strap openings 14 and 14*a* in said rail support system 5, positioned in diametrically opposite sides of the rail support system 5. More specifically, one end of each of the straps is fitted through openings 14 and 14*a*, and then this end is folded back on the strap and sewn, glued, or riveted together. Any other practical means of attachment can also be used. For convenience and balance, openings 14 and 14*a* may be aligned with the rail clips 11 and 11*a*.

Each of the ends of the straps is passed through openings 21 and 21*a* of strap rail clips 20 and 20*a*. The strap rail clips 20 are formed of metal or plastic and provide a compression fit when slid onto the large ladder rail 15. The clips have one side which has a wall which extends downward, bottoms out and then goes partially up for a second wall, forming the shape of an inverse "j" or partial "u."

Once each of the rail straps 12 and 12*a* are passed through openings 21 and 21*a*, the hook and loop sections 4*a* and 4*c* and 4*b* and 4*d* of the two ladder rail are attached together to form a tight fit and thereby position the rail support section 5 properly on large ladder rail 15. The strap rail clips 20 and 20*a* also incorporate that allows the strap assemblies 12 to be passed through.

On one of the rail straps 12*a*, there is attached, normally by sewing, an extension piece which serves as a ladder small rail strap 9. The ladder small rail strap is sewn or attached by a snap, etc. on the outside of (or on top of) one of the rail straps. This ladder small rail strap 9 contains a hook and loop section sewn on part of the underside of the ladder small rail strap. This strap is wrapped around the small ladder rail 16 and is attached to the opposing hook and loop strip 4 which is sewn on top of one of the ladder rail straps 12 to secure the small ladder rail for transporting. A pull tab 8 may also be included. The two rail strap assemblies 12 and 12*a* and the small rail strap 9 may also be made of elastic material or other flexible materials including cloth, plastic, etc.

In another embodiment of the device, and for further ease of use, D-rings 6 and 6*a* attached at each end of the rail support section 5. These rings can be attached in any form to the handle 2 or to separate straps, or can be fitted within the end of the rail strap assemblies that are fed through openings 14 and 14*a* before they are secured on themselves. The D-rings may be made out of metal, plastic, or cloth, or any other appropriate material. A shoulder strap can be attached to the D rings so the ladder may be more easily carried.

To use the ladder handle and transporting device, the first step is to find the balance point of the ladder. Next, the handle is slid onto the inside edge of the rail. The first of the clips is attached to the adjacent outside edge of the ladder rail. The rail strap which is connected to the first clip is secured to the loop side of the strap and the hook and loop sections are pushed together. These steps are repeated with the second clip. The red strap is then wrapped around the small rail of the ladder. Red strap is pressed securely onto the hook & loop.

Figure 9:
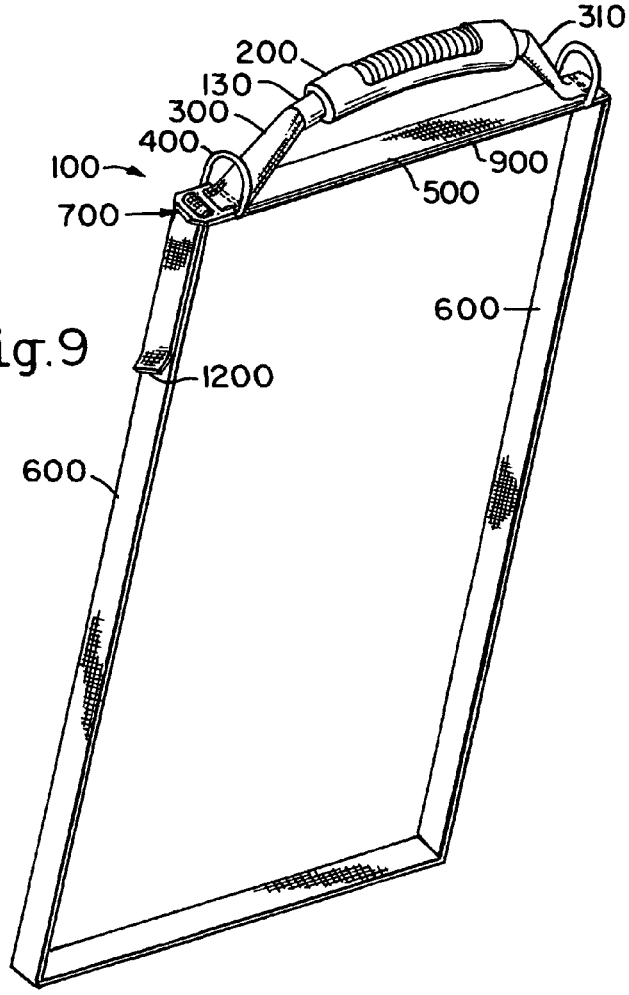
FIG. 9 is a perspective view of the present disclosure.

Another embodiment of the disclosure relates to the use of an extension ladder carrier and device. Referring to FIGS. 9-11, the extension device 100 generally comprises a handle assembly 200 which is attached with fabric fasteners 300, 310 to the handle support section 500 along with one ladder rung strap assemblies 600. The fasteners 300 may be fabric, rope, chain, plastic ties, nylon, or virtually any other material that is sturdy. Flexible materials and even non-flexible materials can be used. In the case of a fabric or cloth material, or any of the other materials, the material is fed through a hollow handle 200. The end material is then folded sewed, buckled, riveted, or heat sealed to the handle support section 500. In one embodiment, the ends of the material are folded back over the ends of the handle support section, before sealing. However, before the ends are secured, stiffening material 130 can be inserted through the cloth or other material into said handle, making the handle easier to grasp and the ladder easier to carry. The handle support section 500 compromises a rectangular fabric spreader 900 and it may also include a stiffening material 100 for added strength and appearance.

At one end of the handle is the handle is the handle catch loop 700. The one ladder rung strap assembly is threaded through the ladder rungs and rapped through and around the ladder catch loop 700 to form a tight fit and thereby position the vulcanized handle assembly 2 properly on side of the ladder 11. The handle catch loop 700 has two openings 701, 702 to thread a material. In one opening 701, one end 302 of one of the fabric fasteners 300 is looped around. It is at that point that one end 501 of the handle support section 500 is fitted into a pocket formed by said one end 302 of one of the fabric The other end of fastener 310 is attached to the handle support section by being sewn, riveted, or glued. The support can be continued to form the ladder rung strap assemblies 600, or the strap assembly can be a continuation of the handle support section.

Additionally, the handle assembly 200 may also have fabric, plastic and or metal D-rings 4 positioned at the point where the handle assembly is sewn to the handle support section 500 at each end at or near the point of connection to the rail support section 500 for the attachment of a shoulder strap. The end of the ladder rung strap 1200 can be cut and or threaded back into ladder rung to keep it secure and for appearance. The rectangular fabric spreader 1000 may incorporate additional features 800 such as metal with powder coating, plastic coating or anodizing on the material to reduce cost, increase strength and or for appearance.

In order to use this device, the device is placed against the rail in the center of the ladder. A support strap is inserted through the first rung on either side of the center. The same support strap is passed through a rung on the other side of the center. The strap is fastened to the buckle and pulled tight. Excess material can be cut off, leaving approximately 12 inches of strap. This strap is fed back into the rung. The ladder can then be safely lifted by the handle.

The extension ladder carrier and handle device can be produced in various sizes and shapes incorporating different application considerations. Additionally, any straps used that require sewing to be attached may also be attached by rivets, gluing, or any other practical methods.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

What we claim is:

1. A ladder handle and transporting device, comprising:

a) a rail support section, said rail support section comprising an elongated flat bar, the elongated bar comprising:
   1) a proximal end; and
   2) a distal end;
   3) a first slot having an opening positioned at said proximal end; and
   4) a second slot having an opening positioned at said distal end;

b) a handle, said handle comprising:
   1) a grip;
   2) a first handle fastener, said first handle fastener comprising:
      A) a first handle end, said first handle end being attached to said first slot;
   3) a second handle fastener, said second handle fastener comprising:
      A) a second handle end, said second handle end being attached to said second slot;

c) a first rail support clip, said first rail support clip projecting outward and then up from said rail support section, said first rail support clip positioned at said proximal of said rail support section;

d) a second rail support clip, said second rail support clip projecting outward and then up from said rail support section, said rail support clip positioned at said distal end of said rail support section;

e) a first rail strap, said first rail strap having a hook and loop connector positioned on an underside of the first rail strap, and a complementary hook and loop positioned on a top side of the first rail strap;

f) a second rail strap, said first rail strap having a hook and loop connector positioned on an underside of the second rail strap, and a complementary hook and loop positioned on a top side of the second rail strap;

g) a first rail strap opening positioned in the proximal end of said rail support section, said first rail strap fished through said first rail strap opening, said first rail strap being folded back on itself and sewn after being fished through said first rail strap opening;

h) a second rail strap opening positioned in the distal end of said rail support section, said second rail strap opening positioned on said opposite side of said rail support section, said second rail strap fished through said second rail strap opening, said second rail strap being folded back on itself and sewn after being fished through said second rail strap opening;

i) a ladder small rail strap, said ladder small rail strap, being an extension of esaid first rail strap, said ladder small rail strap being affixed to outside of said first rail strap, said ladder small rail strap comprising a hook and loop section sewn on part of an underside of said ladder small rail strap;

j) said first rail support clip affixed to a free end of the first rail strap; and k) said second rail support clip affixed to a free end of the second rail strap.

2. The ladder handle and transporting device of claim 1, wherein said handle is comprised of a material selected from the group consisting of vulcanized rubber, rubber, fabric, metal, and plastic.

3. The ladder handle and transporting device of claim 1, wherein said elongated flat bar is comprised of a material selected from the group consisting of metal, plastic, resin, and wood.

4. The ladder handle and transporting device of claim 1, wherein said rail support section further comprises a surface material selected from the group consisting of a powered coating, a plastic coating and an anodized coating.

5. The ladder handle and transporting device of claim 1 further comprising cutouts in the rail support section to reduce weight.

6. The ladder handle and transporting device of claim 1 wherein said first rail support clip and second rail support clip are integrally molded with the rail support section.

7. The ladder handle and transporting device of claim 1 further comprising D rings positioned at either end of the rail support section.

8. A method of using the ladder handle and transporting device of claim 1, comprising:

a) finding the balance point of a ladder to be carried;

b) sliding the handle onto an inside edge of a rail of the ladder;

c) attach the first clip to an adjacent outside edge of the rail of the ladder;

d) secure the rail strap which is connected to the first clip to the loop side of the strap;

e) push the hook and loop connector and complement together;

f) repeat steps a-e with the second clip;

g) wrap the section with the ladder rail strap around a small rail of the ladder, and secure the hook and loop.

* * * * *